United States Patent [19]

Robertson et al.

[11] Patent Number: 4,916,988

[45] Date of Patent: Apr. 17, 1990

[54] RATCHET SCREWDRIVER

[75] Inventors: Harold J. Robertson, Waterloo; Richard D. Cluthe, Wallenstein, both of Canada

[73] Assignee: The George Cluthe Manufacturing Company Limited, Waterloo, Canada

[21] Appl. No.: 286,807

[22] Filed: Dec. 20, 1988

[30] Foreign Application Priority Data

Feb. 10, 1988 [CA] Canada ..... 558651

[51] Int. Cl.[4] ..... B25B 13/00

[52] U.S. Cl. ..... 81/58.3; 192/84 PM; 192/107 M; 74/575; 74/578

[58] Field of Search ..... 192/84 PM, 107 M; 74/575, 578; 81/58.3, 58.4

[56] References Cited

U.S. PATENT DOCUMENTS 4,485,699 12/1984 Fuller ..... 81/58.3 X

FOREIGN PATENT DOCUMENTS 2810101 9/1979 Fed. Rep. of Germany ..... 87/58.3

577156 3/1924 France ..... 87/58.3

*Primary Examiner*—James G. Smith

*Attorney, Agent, or Firm*—Daryl W. Schnurr

[57] ABSTRACT

A ratchet screwdriver contains a magnetic clutch assembly which is accessible by external switching means. The switching means can alternately switch the clutch assembly from a first position to a second position and vice-versa. When the clutch assembly is in the first position the handle will be in a fixed relationship with the shaft and head when the handle is turned in a clockwise direction but will rotate relative to the shaft and head when the handle is turned in a counterclockwise direction. Alternatively, when the clutch assembly is in the second position, the handle will be in a fixed position relative to the shaft and head when the handle is turned in a counterclockwise direction but will rotate relative to the shaft and head when the handle is turned in a clockwise direction. Previous ratchet drivers do not operate smoothly or they are much too complex.

37 Claims, 7 Drawing Sheets

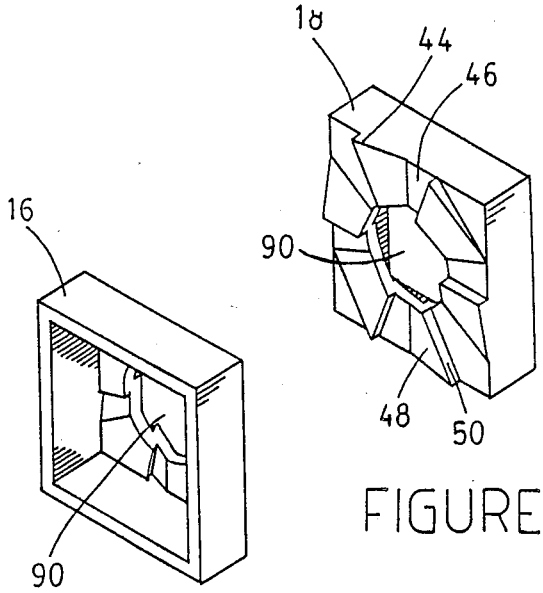
FIGURE 7B
FIGURE 7A
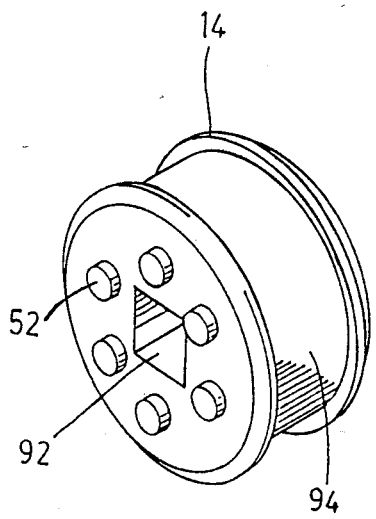
FIGURE 8

RATCHET SCREWDRIVER

BACKGROUND OF THE INVENTION

1. Field of the Invention

This invention relates to a ratchet driver and more particularly, to a ratchet screwdriver that can accommodate various different heads.

2. Description of the Prior Art

Ratchet screwdrivers are known. However, previous screwdrivers do not function smoothly enough or, they are extremely complex, or they cannot be used to fully tighten a screw, or they employ saw teeth, or, the are dependent on the operation of one or more springs. When saw teeth are used, the screwdriver is often unsafe because of the risk of having a finger caught in the saw teeth. When springs are used, the performance of the driver decreases with the wear of the springs. Slippage can occur in some ratchet screwdrivers if they are used to solidly tighten a screw or to begin to loosen a screw that has already been tightened. Some previous ratchet drivers cannot be readily switched from a clockwise drive position to a counterclockwise drive position. Further, the operation of some previous ratchet screwdriver is so rough that they are too difficult to use for their intended purpose. With many known ratchet screwdrivers, when the handle is turned in the reverse non-driving position relative to the head, there is so much friction between the handle and head that the head cannot easily be prevented from turning and also turns in the reverse direction, thereby causing the screw to turn as well. This can result in little or no progress being made in turning the screw in the appropriate direction. For example, if the screw is turned clockwise in the drive position through 180°, when the direction of rotation of the handle is reversed, there is still sufficient friction remaining between the handle and head to cause the screw to turn counterclockwise 180° even though the handle is being turned in a non-drive direction. For any or all of these reasons, ratchet screwdrivers have not attained widespread consumer acceptance and are not widely used.

SUMMARY OF THE INVENTION

A ratchet driver has a handle concentrically mounted on a shaft. The shaft protrudes from one end of said handle and has means for removably mounting a head at a free end thereof. The head rotates as said shaft rotates and there are means to retain said shaft partially within said handle. A magnetic clutch assembly is located within the handle between said handle and said shaft. There are externally accessible switching means to ultimately switch the clutch assembly within a clutch zone from a first position to a second position and vice-versa so that:

(a) when the clutch assembly is in the first position, the handle will be in a fixed relationship with the shaft when the handle is turned in a clockwise direction but will rotate relative to the shaft when the handle is turned in a counterclockwise direction; and (b) when the clutch assembly is in the second position, the handle will be in a fixed relationship with the shaft when the handle is turned in a counterclockwise direction but will rotate relative to the shaft when the handle is turned in a clockwise direction.

In a variation of the invention, the handle has a head located on a free end of said shaft. In a further variation of the invention, the shaft is located entirely within said handle and the head, which is located on shaft protrudes from one end of said handle.

BRIEF DESCRIPTION OF THE DRAWINGS

In drawings which illustrate a preferred embodiment of the invention:

FIG. 7A is a perspective rear view of a drive plate;

FIG. 7B is a perspective front view of a drive plate opposing the drive plate shown in FIG. 7A; and FIG. 8 is a perspective view of a drive wheel.

DESCRIPTION OF A PREFERRED EMBODIMENT

Figure 1:
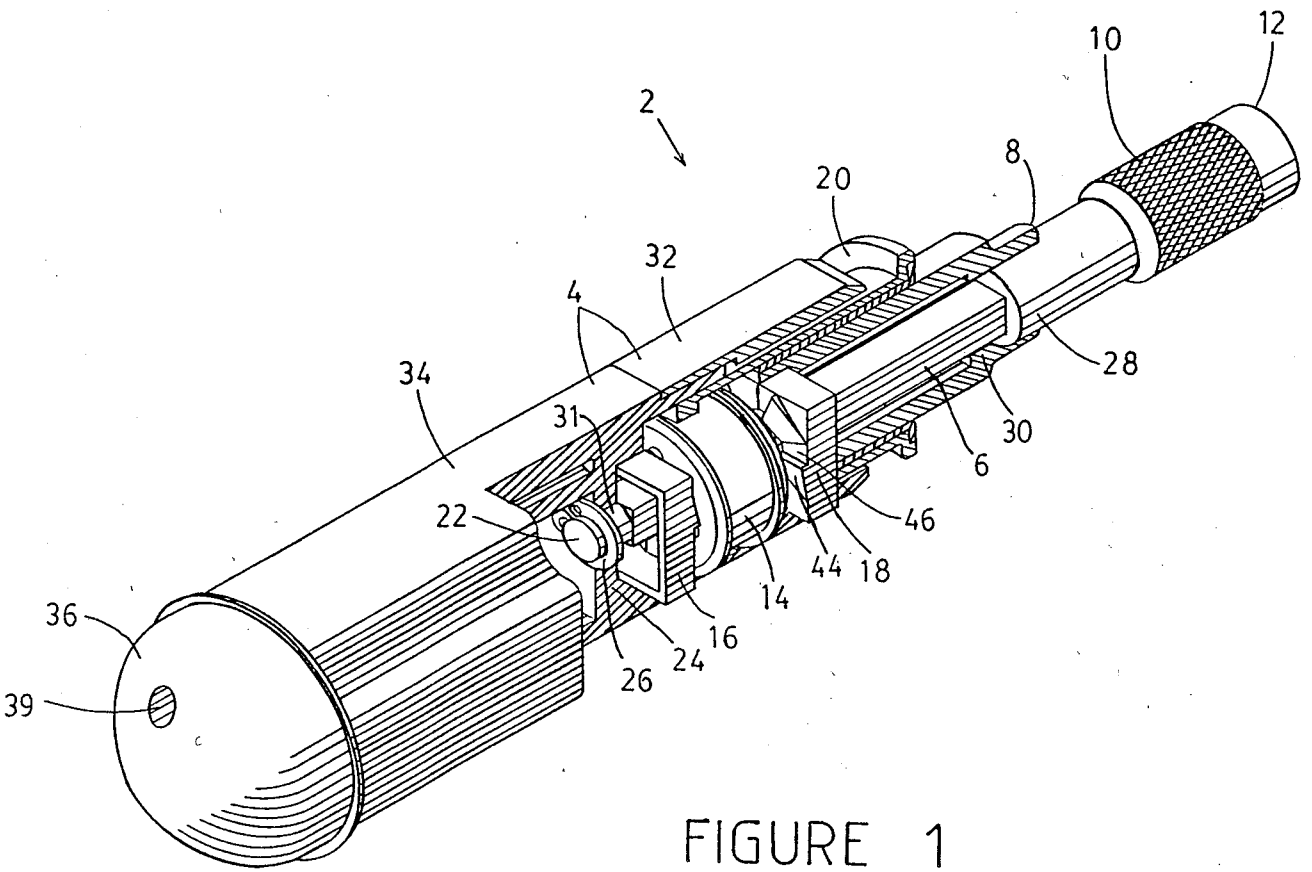
FIG. 1 is a perspective view of a ratchet driver with part of one side cut away to expose a drive mechanism.
Figure 2:
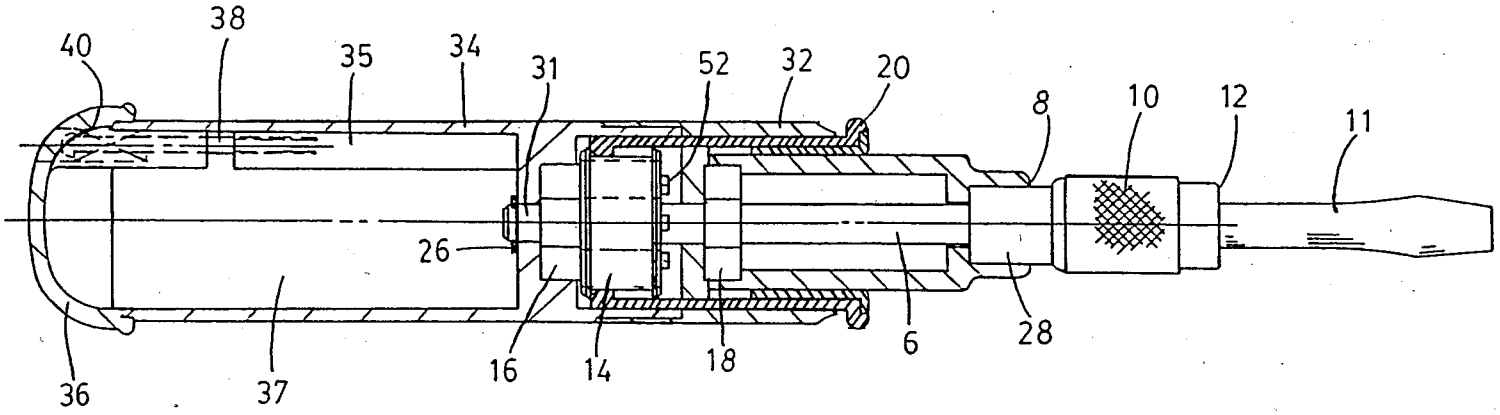
FIG. 2 is a sectional side view of the driver of FIG. 1 with a head installed.

In FIGS. 1 and 2, it can be seen that a ratchet driver 2 has a handle 4 concentrically mounted on a shaft 6. The shaft 6 protrudes from one end 8 of the handle 4 and has means 10 for removably mounting a head 11 at a free end 12 thereof. The head can be virtually of any desirable type, but is preferably one of the common types of screwdriver heads, for example, a standard type of flat head, a square socket head or a PHILLIPS (a trade mark) type. Further, the heads could include hex socket drivers or heads for TORX (a trade mark) drivers. A drive wheel 14 is mounted on said shaft between two stationary drive plates 16, 18. The drive wheel 14 is slidably mounted on the shaft 6 and interconnected to externally accessible switching means 20 so that the drive wheel can be slid along the shaft into and out of contact with either drive plate 16, 18, as desired. The drive wheel 14 and the drive plates 16, 18 are a magnetic clutch assembly and the drive wheel 14 moves into contact with either drive plate 16, 18 within a clutch zone. The drive plates 16, 18 are located at opposite ends of the clutch zone.

An inner end 22 of the shaft 6 has a circular cross-section and is rotatably mounted in a rear seat (not shown in FIGS. 1 and 2) formed in a rear partition 24 of the handle 4. The shaft 6 is held in position by a C-clip 26 mounted in a channel (not shown) in said shaft 6.

A portion 28 of the shaft 6 near the head 11 has a circular cross-section and is rotatably mounted within a forward seat (not shown in FIGS. 1 and 2) within the handle 4. Both seats are circular openings that receive the shaft, are centrally located and are sized relative to the shaft so that the shaft fits snugly within said openings. The forward seat is located in an interior wall 30 of the handle 4. That part of the shaft within the clutch zone has a square cross-section. In the particular shaft 6 shown in the drawings, the portion of the shaft between the circular portions mounted between a cylindrical end portion 31 at the end 22 and the cylindrical portion 28 has a square cross-section. If desired, the portion of the shaft that is located within the clutch zone can have any cross-section other than a circular cross-section. The shaft within the clutch zone could even have a circular cross-section if there were some means to prevent the drive wheel from rotating relative to the shaft.

The handle 4 has a front body 32 and a rear body 34. The rear body is hollow and contains a removable cap 36. The cap 36 can be opened or removed to expose a hollow interior 37 where heads that are not in use can be stored. The cap 36 is attached to the rear body 34 in a known manner. A screw 38 extends through an opening 39 in the cap 36 and into a support 35. That portion of the screw 38 within the cap 36 has a spring 40 mounted thereon. When the cap is pulled outward away from the rear body and rotated relative to said rear body, the spring 40 compresses and the cap remains open. When the cap is appropriately realigned with the rear body 34, the spring 40 will pull the cap into a closed position on the rear body 34.

Preferably, the means for removably mounting a head on the shaft is a collet having a sleeve nut mounted thereon. The drive plates 16, 18 are mounted in a fixed position within the handle so that they cannot rotate relative to the handle. The rear body 34 is separable, during assembly, from the front body 32 when the clip 26 is removed from the shaft 6. The clutch plates 16, 18 are identical to one another but are oriented so that they oppose one another in said handle. The drive plates each have an uneven surface, being a succession of ridges 44 and indentations 46. One side 48 of each ridge is gently sloping while the other side 50 is steep enough to provide an abutment. The drive wheel 14 has a plurality of pins 52 protruding from either side thereof towards said drive plates. When the switching means moves the drive wheel 14 against the drive plate 16, the pins 52 can become interlocked with the abutments 50 on the drive plate 16. When the switching means moves the drive wheel away from the drive plate 16 and into contact with the drive plate 18, the pins 52 on an opposite side of the drive wheel 14 can become interlocked with the abutments 50 on the drive plate 18. Thus, the pins together with the ridges and indentations provide interlocking means between the drive wheel and the drive plates.

The switching means 20 slides the drive wheel from one end of the clutch zone to the other end of the clutch zone. Preferably, the pins 52 and the ridges 44 and indentations 46 are arranged in the form of a circle. In the embodiment shown in the drawings, the pins are magnetic and the drive plates are metallic so that once the switching means moves the pin in contact with one of the drive plates, the interlocking means are held in contact with one another by magnetic forces. Preferably each pin is a tiny magnet. Alternatively, though it is not shown in the drawings, the drive wheel itself could be magnetic or could have one or more magnets located on either side thereof to hold the pins in contact with one of the drive plates after being moved to that position by the switching means.

Figure 3:
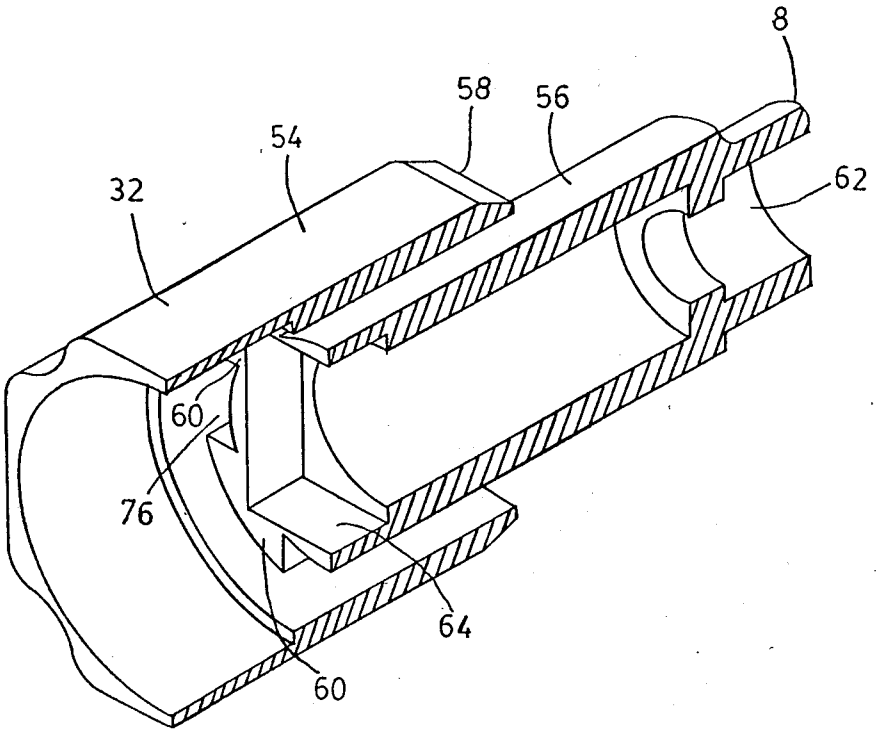
FIG. 3 is a cut away perspective view of a front part of a handle.

The front body 32 is shown in FIG. 3 with the front portion cut away to expose an interior. It can be seen that the front body has an outer shell 54 with an inner shell 56 protruding outwardly beyond a front end 58 of the outer shell 54. The inner shell 56 also has a generally cylindrical shape and is rigidly affixed to the outer shell by four radial arms 60. Since half of the front body 32 is cut away, only two of these arms 60 are shown in FIG. 3. A forward circular opening 62 at a front end 8 of the front body 32 is located in the inner shell 56 and provides a seat for the circular portion 28 of the shaft 6. A square opening 64 provides a seat for the drive plate 18.

Figure 4:
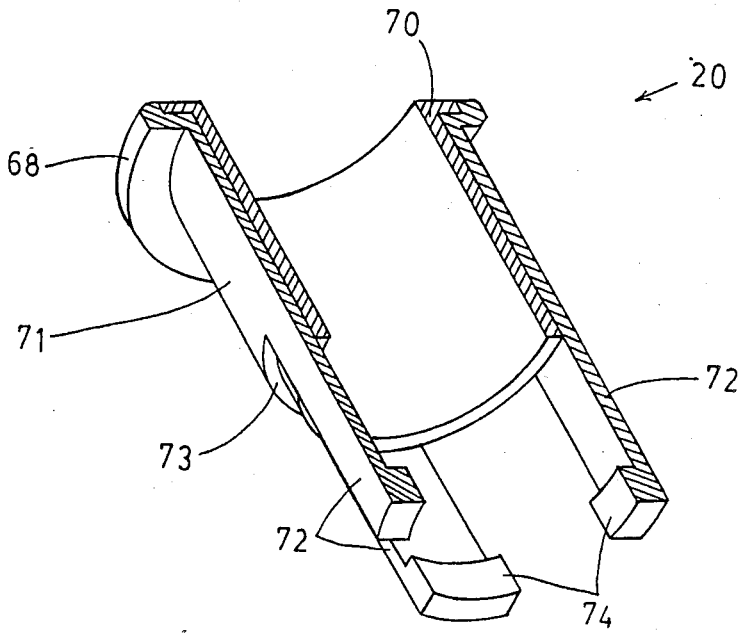
FIG. 4 is a cut away perspective view of switching means.

In FIG. 4, there is shown the switching means 20 with the front portion cut away to expose the interior. The switching means 20 has an outer sleeve 68 and an inner sleeve 70. The outer sleeve 68 has a cylindrical base portion 71 with a series of prongs 72 extending from an interior end 73 of said base portion. Each prong 72 has an inwardly extending flange 74 thereon. The inner sleeve 70 is utilized to allow the switching means 20 to be made in a plastic mold and is affixed by a suitable adhesive to the outer sleeve 68. If desired, the switching means 20 could be manufactured with the inner sleeve 70 made integral with the outer sleeve 68. The switching means 20 has four prongs 72, each prong extending through one of the openings 76 (see FIG. 3) located between the arms 60 of the front body 32. The switching means 20 provides 360° accessibility to a user.

Figure 5:
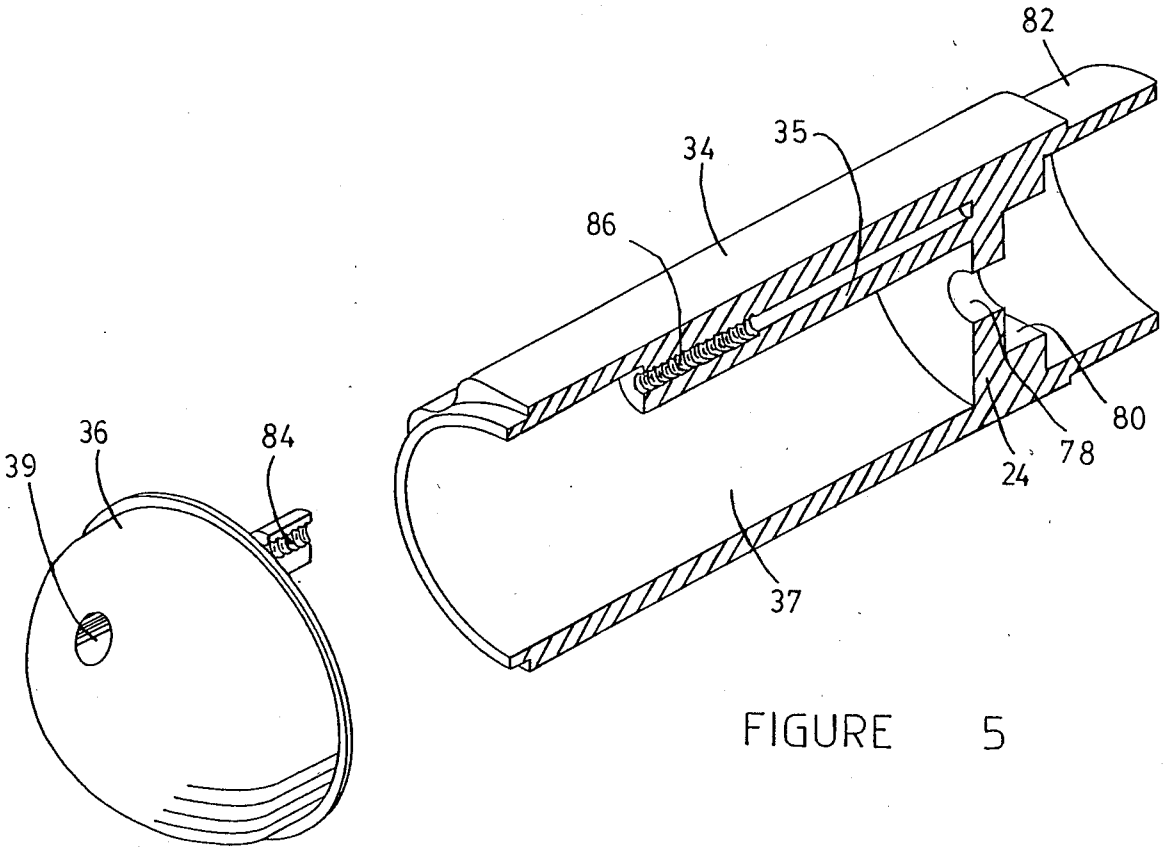
FIG. 5 is an exploded partially cut away perspective view of a body of a handle and a cap.

In FIG. 5, there is shown an exploded perspective view of the cap 36 and the rear body 34 with the front portion of the rear body cut away to expose an interior. A circular opening 78 in the partition 24 provides a seat for the cylindrical section 31 portion of the shaft 6 at an inner end 22. The shaft 6 is thus rotatably mounted in the seat or opening 78 of the rear body 34 at one end and in the seat or opening 62 in the front body 32 at the other end. A square-shaped opening 80 adjacent to the opening 78 in the partition 24 provides a seat for the drive plate 16. The rear body 34 has a cylindrical section 82 of reduced diameter at a forward end thereof, said section being sized to fit within a rear portion of the front body 32 as shown in FIGS. 1 and 2. The screw and spring for holding the cap 36 on the rear body 34 is not shown in FIG. 5. However, the threaded openings 84, 86 in the cap 36 and rear body 34 respectively for holding the screw are shown.

Figure 6:
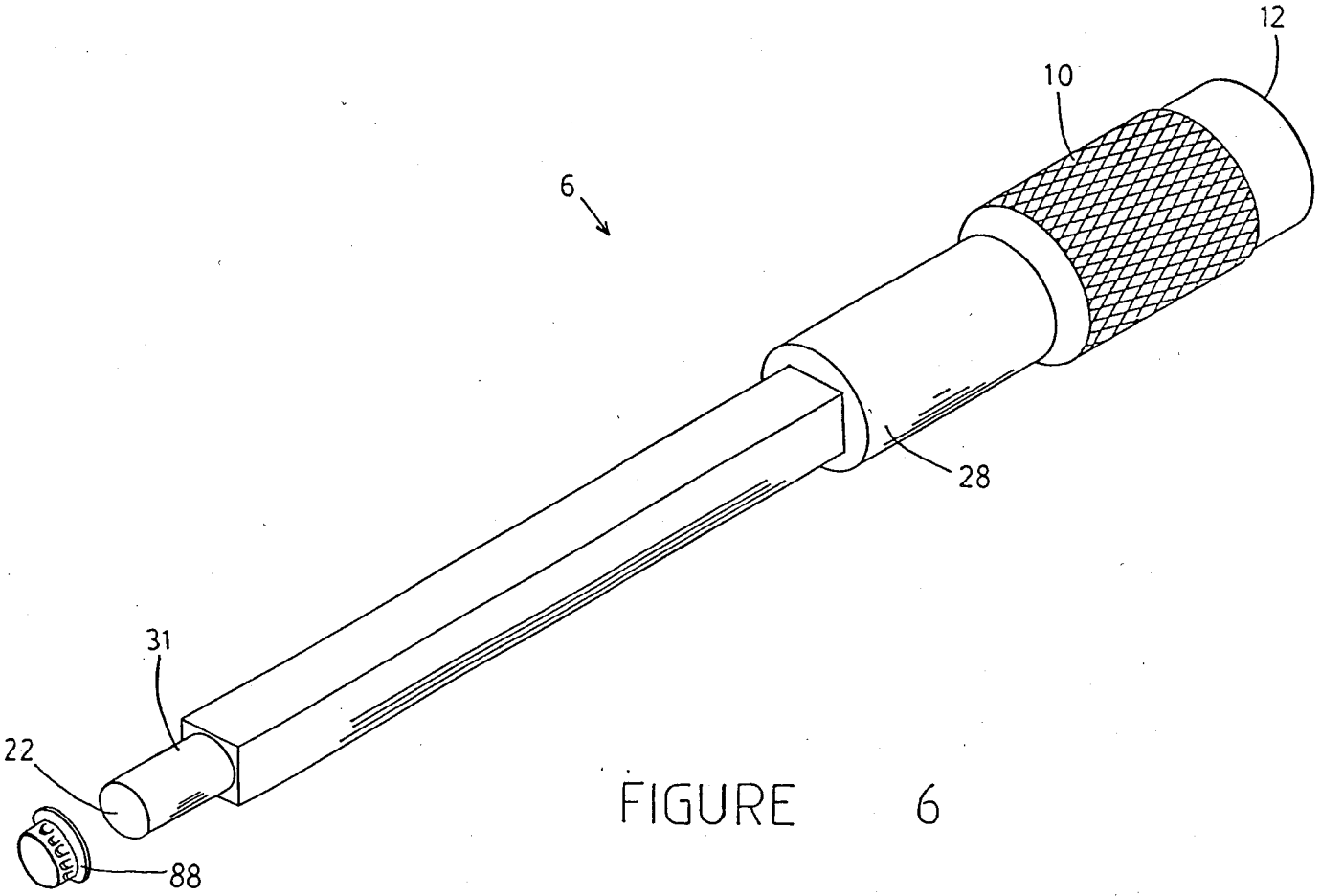
FIG. 6 is a perspective view of a shaft and accompanying clip, said clip being a variation of the clip of FIGS. 1 and 2.

In FIG. 6, there is shown the shaft 6 and the clip 88. The clip 88 is a variation of the clip 26. It can be seen that the clip 88 is sized to fit on an inner end 22 of said shaft 6. Access to the clip 88 can be attained through the hollow interior 37. Other types of clips could also be used.

In FIG. 7, the drive plates 16, 18 are shown in the same opposed position in which they are oriented in the handle 4. It can be seen that the two drive plates are identical to one another and have a square periphery with an enlarged central opening 90 therein to allow the shaft 6 to pass through each drive plate and to rotate relative thereto without contacting the drive plate.

In FIG. 8, there is shown a perspective view of the drive wheel 14 with pins 52 extending therefrom. The drive wheel 14 has a central opening 92 with a square cross-section corresponding to the square cross-section of the shaft 6 between the cylindrical section 31 at the end 22 and the cylindrical portion 28 near a free end 12. The opening 92 is sized so that the drive wheel 14 can slide longitudinally along the shaft 6 but cannot rotate relative thereto. While the shape of the shaft 6 and opening 92 is square, various other shapes could be utilized within the scope of the attached claims. The drive wheel 14 has a peripheral channel 94 located therein to receive the flanges 74 on the prongs 2 of the switching means 20 as shown in FIGS. 1 and 2.

By comparing FIGS. 7 and 8, it can be seen that the number and locations of indentations 46 on the drive plates 16, 18 correspond to the number and location of the pins 52 on the drive wheel 14. The pins on each side of the drive wheel 14 are preferably identical to one another and are, still more preferably, the same pin that extends out from either side.

Preferably, the shaft, head, pins and drive plates are made of metal and the handle and drive wheel are made from a suitable molded plastic. In operation, when the switching means is in the position shown in FIGS. 1 and 2 (i.e. the first position) so that the pins of the drive wheel 13 are in contact with the drive plate 16, the pins 52 will interlock with the corresponding abutments 50 when the handle is turned in a clockwise direction. In other words, the pins 52 will not override the ridges 44 of the drive plate 16. Thus, the shaft 6 will rotate with the handle 4 in a clockwise direction. On the other hand, when the handle 4 is turned in a counterclockwise direction, the pins 52 will override the ridges 44 by riding up the gentle slopes 48 of said ridges. Thus, the handle 4 and the drive plate 16 can be rotated in a counterclockwise direction while the shaft 6 and drive wheel 14 remain stationary. When the switching means is in the position shown in FIG. 1, the ratchet driver can be used with an appropriate head to drive a standard screw into an object. The handle will exert clockwise force on the head when turned in a clockwise direction but will slip relative to the shaft when turned in a counterclockwise position. Thus a screw can be turned into an object by turning the handle back and forth, but without removing the head out of interlocking contact with the screw or changing a grip of a user on said handle.

When the switching means 20 is moved towards the front end 8 of the handle, the drive wheel 14 will move out of contact with the drive plate 16 and into contact with the drive plate 18 (i.e. the second position). In this position, which is the opposite position to that shown in FIGS. 1 and 2, when the handle is turned in a clockwise direction, the pins 52 of the drive wheel 14 will override the ridges 44 of the drive plate 18 by riding up the gentle slopes 48. In other words, the handle will turn clockwise while the drive wheel 14 and shaft 6 will remain stationary. On the other hand, when the handle 4 is turned in a counterclockwise direction, the pins 52 of the drive wheel 14 will interlock with the drive plate 18 as the pins will be located within the indentations 46 and will rest against the abutments 50 of the ridges 44. The pins 52 will not override the ridges 44 because the abutments 50 are too steep. Thus, the drive wheel 14 and the shaft 6 will turn in a counterclockwise direction along with the handle 4. In other words, a counterclockwise driving force will be applied to the shaft 6 when the handle is turned in a counterclockwise direction but slippage will occur relative to the shaft 6 when the handle is turned in a clockwise direction. This position of the switching means will be used to remove a standard screw from an object using an appropriate head.

Obviously, if the ridges 44 along the drive plates 16, 18 where designed so that the location of the gentle slopes 48 and abutments 50 were reversed from that shown in the drawings, the switching means 20 would then cause the ratchet driver to operate in exactly the opposite manner to which the driver shown in the drawings operates. In other words, the driving force on the head would be counterclockwise when the switching means was in the position shown in FIGS. 1 and 2 and clockwise when the switching means was in the opposite position. Numerous other changes could be made within the scope of the attached claims. For example, the switching means 20 could be re-designed to move the drive wheel from one drive plate to the other in a different manner. One way of re-designing the switching means would be to locate slots in the handle on opposite sides of the drive wheel with means in the slots for moving the drive wheel back and forth along the shaft.

During use, when the screw that is being turned is very loose, it may be necessary for a user to manually hold a free end of the shaft to prevent it from rotating with the handle in the non-drive direction. The manual force required will be very small.

What we claim as our invention is:

1. A ratchet driver comprises a handle concentrically mounted on a shaft, said shaft protruding from one end of said handle and having means for removably mounting a head at a free end thereof said head rotating as said shaft rotates, with means to retain said shaft partially within said handle, a magnetic clutch assembly being located within said handle between said handle and said shaft, with externally accessible switching means to alternately switch the clutch assembly within a clutch zone from a first position to a second position and vice-versa so that:

(a) when the clutch assembly is in the first position, the handle will be in a fixed relationship with the shaft when the handle is turned in a clockwise direction but will rotate relative to the shaft when the handle is turned in a counterclockwise direction; and (b) when the clutch assembly is in the second position, the handle will be in a fixed relationship with the shaft when the handle is turned in a counterclockwise direction but will rotate relative to the shaft when the handle is turned in a clockwise direction.

2. A ratchet driver as claimed in claim 1 wherein said shaft is rotatably mounted in a forward seat and a rear seat, both seats being within said handle.

3. A ratchet driver as claimed in claim 2 wherein that portion of the shaft located within the clutch zone has a non-circular cross-section.

4. A ratchet driver as claimed in claim 3 wherein the clutch assembly has a movable portion and a stationary portion, said movable portion being a drive wheel, said drive wheel being slidably mounted on said shaft within said clutch zone and having a centrally located opening therein corresponding in shape to the non-circular cross-section of said shaft so that the drive wheel cannot rotate relative to said shaft.

5. A ratchet driver as claimed in claim 4 wherein that portion of the shaft located within the clutch zone has a square cross-section and the centrally located opening in the drive wheel has a corresponding shape.

6. A ratchet driver as claimed in claim 4 wherein the stationary portion of the clutch assembly is two drive plates, one being located at each end of the clutch zone, said drive plates being fixedly mounted within said handle between the forward seat and the rear seat that support said shaft.

7. A ratchet driver as claimed in claim 6 wherein there are interlocking means on said drive wheel and drive plates so that the drive wheel can become alternately interlocked with a first drive plate so that the drive wheel will not rotate in a clockwise direction relative to the first drive plate but will rotate in a counterclockwise direction or with the second drive plate so that the drive wheel will not rotate relative to the second drive plate in a counterclockwise direction but will rotate in a clockwise direction.

8. A ratchet driver as claimed in claim 7 wherein the drive plates are identical to one another but are oriented so that they oppose one another within said handle.

9. A ratchet driver as claimed in claim 8 wherein the interlocking means are a plurality of pins protruding from either side of said drive wheel towards said drive plates and an uneven surface facing said pins in each of said drive plates.

10. A ratchet driver as claimed in claim 9 wherein the uneven surface is a succession of ridges and indentations with one side of each ridge being gently sloping and the other side being steep enough to provide an abutment for said pins.

11. A ratchet driver as claimed in claim 10 wherein the pins and ridges and indentations are arranged in the form of a circle.

12. A ratchet driver as claimed in claim 11 wherein each of the drive plates has a square periphery and an enlarged central opening to allow the shaft to pass through each drive plate and to rotate relative thereto without contacting either drive plate.

13. A ratchet driver as claimed in any one of claims 4, 7 or 11 wherein the switching means slides the drive wheel from one end of the clutch zone to the other end of the clutch zone.

14. A ratchet driver as claimed in any one of claims 7, 9 or 11 wherein the interlocking means are held in contact with one another by magnetic attraction.

15. A ratchet driver as claimed in any one of claims 7, 9 or 11 wherein the drive plates are made of metal and the pins in the drive wheel are magnetic.

16. A ratchet driver as claimed in any one of claims 4, 7 or 11 wherein the switching means has a cylindrical forward end that protrudes from a forward end of said handle to provide 360° accessibility to a user, the switching means being in contact with said drive wheel.

17. A ratchet driver as claimed in any one of claims 4, 7 or 11 wherein the switching means has a plurality of prongs that protrude through suitable channels within said handle, each prong having an inwardly projecting flange thereon, that rests in a peripheral channel of said drive wheel, said switching means having a cylindrical forward end that protrudes from a forward end of said handle to provide 360° accessibility to a user.

18. A ratchet driver as claimed in any one of claims 6, 9 or 12 wherein the handle has a front body and a rear body each body containing one of said drive plates.

19. A ratchet driver as claimed in any one of claims 2, 6 or 10 wherein the forward seat is located in an inner shell mounted within an outer shell of a front body of the handle.

20. A ratchet driver as claimed in claim 12 wherein there is a container located in a hollow end of said handle opposite to said head, said container being sized to contain various alternate heads and having a movable cap thereon, said alternate heads being readily removable from said container for mounting on a free end of said shaft.

21. A ratchet driver as claimed in any one of claims 9, 10 or 11 wherein the shaft, head, pins and drive plates are made of metal and the handle is made from a suitable moulded plastic.

22. A ratchet driver as claimed in claim 12 wherein a free end of said shaft has an adapter mounted thereon said adapter having an external screw thread and opposing slits on at least two sides, with a sleeve nut being designed to be screwed onto said adapter to hold a head in a rigid position relative to said shaft.

23. A ratchet driver as claimed in claim 2 wherein an inner end of said shaft is rotatably mounted in the rear seat, being a rear centrally located circular opening formed in said handle and a portion of said shaft near said free end is rotatably mounted in a forward seat, being a forward centrally located circular opening formed in said handle, said rear and forward openings being sized relative to said shaft at said locations so that the shaft fits snugly within said openings, the cross-sectional shape of the shaft at these locations being circular.

24. A ratchet driver as claimed in claim 23 wherein the means to retain said shaft partially within said handle is a clip inserted into a suitable channel in said shaft to a rear of said rear centrally located opening.

25. A ratchet driver comprises a handle concentrically mounted on a shaft, a free end of said shaft protruding from one end of said handle, with a head located on a free end of said shaft, said head rotating as said shaft rotates, with means to retain said shaft partially within said handle, a magnetic clutch assembly being located within said handle between said handle and said shaft, with externally accessible switching means to alternately switch the clutch assembly with a clutch zone from a first position to a second position and vice-versa so that:

(a) when the clutch assembly is in the first position, the handle will be in a fixed relationship with the shaft when the handle is turned in a clockwise direction but will rotate relative to the shaft when the handle is turned in a counterclockwise direction; and (b) when the clutch assembly is in the second position, the handle will be in a fixed relationship with the shaft when the handle is turned in a counterclockwise direction but will rotate relative to the shaft when the handle is turned in a clockwise direction.

26. A ratchet driver as claimed in claim 25 wherein the head is integral with said shaft.

27. A ratchet driver as claimed in claim 25 wherein the shaft is rotatably mounted in a forward seat and a rear seat, both seats being within said handle.

28. A ratchet driver as claimed in claim 27 wherein that portion of the shaft located within the clutch zone has a non-circular cross-section.

29. A ratchet driver as claimed in claim 28 wherein the clutch assembly has a movable portion and a stationary portion, said movable portion being a drive wheel, said drive wheel being slidably mounted on said shaft within said clutch zone and having a centrally located opening therein corresponding in shape to the non-circular cross-section of said shaft so that the drive wheel cannot rotate relative to said shaft.

30. A ratchet driver as claimed in claim 29 wherein that portion of the shaft located within the clutch zone has a square cross-section and the centrally located opening in the drive wheel has a corresponding shape.

31. A ratchet driver as claimed in claim 29 wherein the stationary portion of the clutch assembly is two drive plates, one being located at each end of the clutch zone, said drive plate being fixedly mounted within said handle between the forward seat and the rear seat that support said shaft.

32. A ratchet driver as claimed in claim 31 wherein there are interlocking means on said drive wheel and drive plates so that the drive wheel can become alternately interlocked with a first drive plate so that the drive wheel will not rotate in a clockwise direction relative to the first drive plate but will rotate in a counterclockwise direction or with the second drive plate so that the drive wheel will not rotate relative to the second drive plate in a counterclockwise direction but will rotate in a clockwise direction.

33. A ratchet driver as claimed in claim 32 wherein the drive plates are identical to one another but are oriented so that they oppose one another within said handle.

34. A ratchet driver as claimed in claim 33 wherein the interlocking means are a plurality of pins protruding from either side of said drive wheel towards said drive plates and an uneven surface facing said pins in each of said drive plates.

35. A ratchet driver as claimed in claim 34 wherein the uneven surface is a succession of ridges and indentations with one side of each ridge being gently sloping and the other side being steep enough to provide an abutment for said pins.

36. A ratchet driver as claimed in claim 35 wherein the pins and ridges and indentations are arranged in the form of a circle.

37. A ratchet driver comprises a handle concentrically mounted on a shaft, with a head located on a free end of said shaft, said head protruding from one end of said handle, said head rotating as said shaft rotates, with means to retain said shaft within said handle, a magnetic clutch assembly being located within said handle between said handle and said shaft, with externally accessible switching means to alternately switch the clutch assembly with a clutch zone from a first position to a second position and vice-versa so that:

(a) when the clutch assembly is in the first position, the handle will be in a fixed relationship with the shaft when the handle is turned in a clockwise direction but will rotate relative to the shaft when the handle is turned in a counterclockwise direction; and (b) when the clutch assembly is in the second position, the handle will be in a fixed relationship with the shaft when the handle is turned in a counterclockwise direction but will rotate relative to the shaft when the handle is turned in a clockwise direction.

* * * * *